US005781201A

United States Patent [19]

McCormack et al.

[11] Patent Number: 5,781,201

[45] Date of Patent: Jul. 14, 1998

[54] METHOD FOR PROVIDING IMPROVED GRAPHICS PERFORMANCE THROUGH ATYPICAL PIXEL STORAGE IN VIDEO MEMORY

[75] Inventors: Joel J. McCormack; Robert S. McNamara, both of Portola Valley, Calif.; Larry D. Seiler, Boylston; Christopher C. Gianos, Sterling, both of Mass.

[73] Assignee: Digital Equipment Corporation, Maynard, Mass.

[21] Appl. No.: 642,149

[22] Filed: May 1, 1996

[51] Int. Cl.[6] ..... G09G 5/36

[52] U.S. Cl. ..... 345/509; 345/515; 345/203; 711/5; 711/157

[58] Field of Search ..... 395/501–503, 395/507–510, 515–518, 520, 521, 523, 405, 481, 484, 495; 345/501–503, 507–510, 515–518, 520, 521, 523, 186–190, 188, 203, 200; 711/5, 154, 157, 168

[56] References Cited

U.S. PATENT DOCUMENTS

| | | | |
|---|---|---|---|
| 5,303,200 | 4/1994 | Elrod et al. | 365/230.05 |
| 5,422,657 | 6/1995 | Wang et al. | 345/186 |
| 5,522,027 | 5/1996 | Matsumoto et al. | 395/503 |
| 5,542,041 | 7/1996 | Corona | 395/501 |
| 5,579,473 | 11/1996 | Schlapp et al. | 395/501 |
| 5,640,545 | 6/1997 | Baden et al. | 395/515 |
| 5,644,758 | 7/1997 | Patrick et al. | 395/525 |

OTHER PUBLICATIONS

IBM Microelectronics, RGB561, Workstation Graphics, Preliminary Rev. 1.0 Mar. 23, 1994, pp. 1–68.

Seiler, et al., U.S. Patent Application Serial No. 08/270,189, "Method for Increasing the Performance of Lines Drawn into a Frame Buffer Memory", filed Jul. 1, 1994.

*Primary Examiner*—Matthew M. Kim
*Assistant Examiner*—U. Chauhan
*Attorney, Agent, or Firm*—Gary E. Ross

[57] ABSTRACT

A method for improving the performance of a graphics system includes the steps of allocating appropriate pixels to slices of memory such that corresponding subsets of bits of neighboring pixels are allocated to different slices of memory, where 'neighboring pixels' includes both consecutive pixels in a scan line, or pixels in consecutive scan lines. In addition, hardware is provided that allows for the individual memory slices to be independently accessed, thus allowed each slice to access data from a different 64 bit word in video memory during one video access period. Controllers which independently access the memory slices are advantageously totally time independent, to allow the most flexibility in the starting and finishing of the access of the memory slice. Performance is further gained by buffering of both the read and write requests to the video memory. Buffering requests allows reads and writes to neighboring locations to be merged to allow for the maximal bus utilization and minimizes the number of stalls in the video subsystem.

20 Claims, 6 Drawing Sheets

METHOD FOR PROVIDING IMPROVED GRAPHICS PERFORMANCE THROUGH ATYPICAL PIXEL STORAGE IN VIDEO MEMORY

FIELD OF THE INVENTION

This invention relates generally to the field of computer systems, and more specifically to a method for storing graphics information in a computer system.

BACKGROUND OF THE INVENTION

As it is known in the art, graphics hardware typically includes a graphics controller, coupled to receive commands from a central processor unit (CPU). The graphics controller is coupled via a video bus to a video frame buffer memory. The video frame buffer is a memory device that stores the representation of the images to be displayed on the monitor. The video frame buffer memory provides image data to a digital-to-analog converter coupled to a display monitor.

Each dot of the image displayed on the monitor is stored as a picture element, known in the art as a 'pixel'. The image displayed on the monitor screen is broken down into scan lines. Pixels are periodically read from the frame buffer to refresh the monitor image.

The image is updated via commands from the CPU which alter the frame buffer contents. The altered pixels are projected during the next cycle through the video frame buffer. Graphics performance is typically measured by the time required to update data in the video frame buffer. As such, the graphics controller often includes hardware for optimizing performance of certain operations performed to the video frame buffer, such as copying, drawing lines, or stippling data. Each of these optimizations attempts to ensure that the largest numbers of pixels affected by the operation are updated in a given video read or write cycle.

However, the above optimization techniques are ineffective if the video bus that couples the graphics controller to the frame buffer memory is underutilized, and thus cannot reflect the changes to the frame buffer at the rate that the changes are provided by the graphics controller. The video bus is underutilized when some of the pins of the video frame buffer are unused (idle) during a frame buffer read or write operation, and so video memory bandwidth is not fully exploited.

Graphics applications may operate, for example, in either 32 bit mode (where 32 bits are used to define each pixel), 16 bit mode (where 16 bits are used to define each pixel) or 8 bit mode (where 8 bits are used to define each pixel). During execution of a graphics application, various situations may arise where the video bus 65 is underutilized. One situation arises from simultaneous execution of applications that allocate different numbers of bits per pixel. For example, in order to display 32 bit, 16 bit, and 8 bit applications simultaneously, most systems allocate 32 bits per pixel to the portion of the frame buffer being displayed on the monitor. Sixteen and eight bit applications use only a part of each 32 bit pixel, and thus use only 50% and 25% of the video bus bandwidth, respectively.

A second situation where the video bus is underutilized results because many 32 bit applications frequently modify only 24 bits of each 32 bit pixel, and therefore use only 75% of the video bus bandwidth. Such operations are hereafter referred to as 'partial pixel updates.' A similar partial pixel update problem exists for 16 bit applications that update only one byte of each pixel, thus leaving the bus 50% under utilized. Eight bit applications may also underutilize the video bus when trying to paint an object that is narrower than the bits available each cycle on the video bus even though the entire 'pixel' is updated for each operation.

In addition, the video bus may be under utilized during stippling operations, when not every pixel in a contiguous area is updated, for example painting a checkerboard area. The problem is similar to that described above for painting narrow objects because it may leave slices idle across a scan line as pixels which do not need updating are skipped.

For example, referring briefly to FIG. 1A, an example of a typical, prior art layout of a scan line is shown. Scan line 80, here shown shaded, comprises a plurality of pixels, for example, 1024 pixels, stored in video frame buffer memory. Only the first 6 pixels of the scan line are illustrated.

Each pixel of data is shown to comprise 32 bits (4 bytes) of picture data. For ease of reference, each individual byte of pixel data will be referred to herein as P#.B#, indicating the Pixel number. Byte number of the corresponding byte of data.

The video memory is apportioned into four discrete slices. Each slice of video memory provides 16 bits of video data per cycle, and together the four slices are capable of providing 64 bits of data per cycle.

As indicated in FIG. 1A, in the prior art layout, slice 0 stores all of the byte 0 pixel data, slice 1 stores all of the byte 1 data, slice 2 stores all of the byte 2 data, and slice 3 stores all of the byte 3 data for each pixel. Although this pixel allocation appears initially to be straightforward, it tends to reduce overall performance when not every byte of every pixel is being accessed. This is quite common when running certain graphics applications that only need 8 bit pixels simultaneously with other applications that need 32 bit pixels. The 8 bit applications just modify one byte of each 32 bit pixel.

A typical partial pixel operation involves updating only byte 0 of each pixel in the scan line in each cycle. In FIG. 1A, the byte to be modified in each pixel is shown in bold. Because only one byte of the pixel is accessed each cycle, the same memory slice is accessed each cycle while the other three remain idle, and therefore only 16 bits of the video bus are utilized. Accordingly, it can be seen that with the prior art allocation, only ¼ of the bus is being utilized, causing a reduction in the overall performance of the graphics subsystem.

One solution to the above problems is described in patent application Ser. No. 08/270,194, entitled "Method for Quickly Painting and Copying Shallow Pixels on a Deep Frame Buffer", by Seiler, McNamara, Gianos, and McCormack, filed Jul. 1, 1994, now U.S. Pat. No. 5,696,945, and hereinafter referred to as the McNamara patent. An example of a typical allocation of bytes to slices in the prior art patent is shown in FIG. 1B.

The McNamara patent addressed the problems of bus under utilization for some partial pixel operations. The McNamara patent provided a frame buffer in which 32 physical bits were allocated for each pixel. In the patent, the storage of pixels in the frame buffer was rearranged such that when 8 bit pixel applications or 16 bit pixel applications were executing in the 32 bit pixel frame buffer, the maximum amount of pixels could be retrieved from the frame buffer in any given cycle. For example, assuming a 64 bit data bus, either two 32 bit pixels, four 16 bit pixels, or eight 8 bit pixels could be retrieved.

As shown in FIG. 1B, the video memory is shown apportioned into four slices. Each slice is further divided into four distinct addressable blocks, where each block stores two bytes of pixel data. If a 32 bit graphics system is executing a 32 bit application, 2 pixels may be accessed each cycle as shown in bus output 10. If the graphics system is executing a 16 bit application, 4 pixels may be accessed each cycle as shown on bus output 12. And, if the graphics system is executing an 8 bit application, 8 pixels may be accessed each cycle as shown on bus output 14.

Although the McNamara patent provided improved performance for partial pixel updates, there are some drawbacks to the design. First, the method of allocating the pixels requires a large number of memory chips for storing the different pixels. Second, that patent provides no improvement for stippling operations, because the controllers operated in lock step unless they were operating in line mode. Third, although the McNamara patent solved the problem of 8 or 16 bit applications executing in a 32 bit graphics system, it did not solve all the problems associated with partial pixel operations; such as when 3 bytes of a 32 bit pixel are accessed during Z buffering and Stencil operations. Typically, each 32 bit Z/Stencil buffer pixel comprises two fields: an 8 bit stencil field, and a 24 bit Z value field. The majority of 3 dimensional operations only read and write the Z value field, and not the stencil field, so they operate on only three bytes of each 32 bit pixel. While the atypical layout provided by the McNamara patent could facilitate Z buffer operations, a design change requiring memory controller re-design and increased buffering of operations would be required.

Other performance problems arise in situations where pixels in different scan lines are accessed, for example during a line draw operation. One worst case example is the performance decrease associated with line drawing operations, particularly the vertical line draw operation.

Take, for example, a vertical line drawn at the first pixel location of a scan line in FIG. 1A. In order to draw the first two pixels, memory slice 00 would be accessed twice; once to access the first pixel in scan line 80, and a second time to access the pixel in scan line 81. As a result, because only one byte of one memory slice is accessed during the line draw operation, the video bus 65 (FIG. 3) is only 12.5% utilized, thereby decreasing the overall graphics performance.

Because underutilization of the video memory bus directly impacts the performance of the graphics subsystem, it would be desirable to improve the utilization of the video bus without undue hardware complexity.

SUMMARY OF THE INVENTION

According to one aspect of the invention, a method for improving the performance of a graphics system including a memory apportioned into a plurality of slices includes the steps of rearranging subsets of bits within the pixels input to the graphics system before storing the pixels in the memory. Each pixel is rearranged such that corresponding subsets of bits of vertically or horizontally neighboring pixels are stored in different, simultaneously accessible locations of memory. Each slice of memory is independently controlled and addressed by a dedicated memory controller. With such an arrangement, an atypical arrangement of pixel data in video memory is provided, which allows for increased utilization of the video memory bus and thereby increases the overall graphics system performance.

DESCRIPTION OF THE PREFERRED EMBODIMENT

Figure 2:
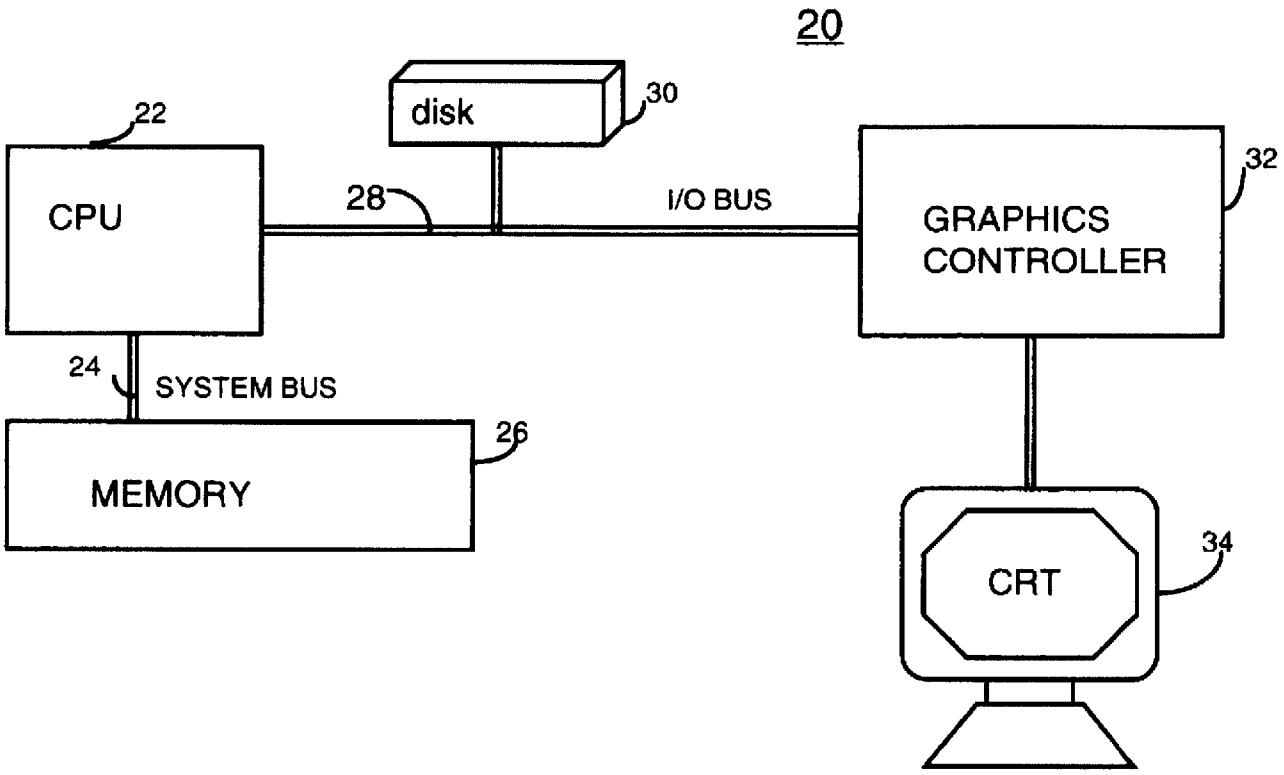
FIG. 2 is a block diagram of a computer system in which the present invention may be used.

Referring now to FIG. 2, a computer system 20 according to the invention is shown to include a Central Processing Unit (CPU) 22, coupled via a system bus 24 to communicate with a memory 26. The CPU is also coupled via an Input/Output (I/O) bus 28 to communicate with external devices such as a disk controller 30 or a graphics controller 32. The graphics controller 32 is coupled to provide image data to a Cathode Ray Tube (CRT) monitor 34.

During operation of the computer system 20, the CPU 22 operates on applications using an instruction stream stored in memory 26. Many of the applications run on the CPU 22 provide image data or drawing requests to be displayed on the CRT 34. Generally a software program, known in the art as a graphics driver, controls the display on the CRT of image data or drawing requests provided by different applications by providing appropriate address, data, and drawing commands over the I/O bus 28 to the graphics controller 32. The commands may include commands to copy data from memory 26 to memory in the graphics device 32, or commands such as line drawing, or stippling of graphics data.

The I/O bus 28 is a 32 bit bus which communicates using a defined protocol with external devices, such as a disk 30, console, etc. There are a variety of I/O busses currently available in the market, each of which have their own defined protocol. The I/O bus 28 used in one embodiment of the invention operates according to a Peripheral Component Interconnect (PCI) protocol, and thus the graphics device 32 is designed in accordance with the PCI® protocol. The PCI® bus is a high performance bus with a maximum bandwidth equal to 133 Mbytes/sec. It is to be understood that this invention could be adapted by one of ordinary skill in the art to a system arrangement using another I/O bus protocol. Alternatively, this invention could be practiced in a system where the graphics controller 32 is attached to the system bus or where the graphics controller is incorporated directly in the CPU.

Figure 3:
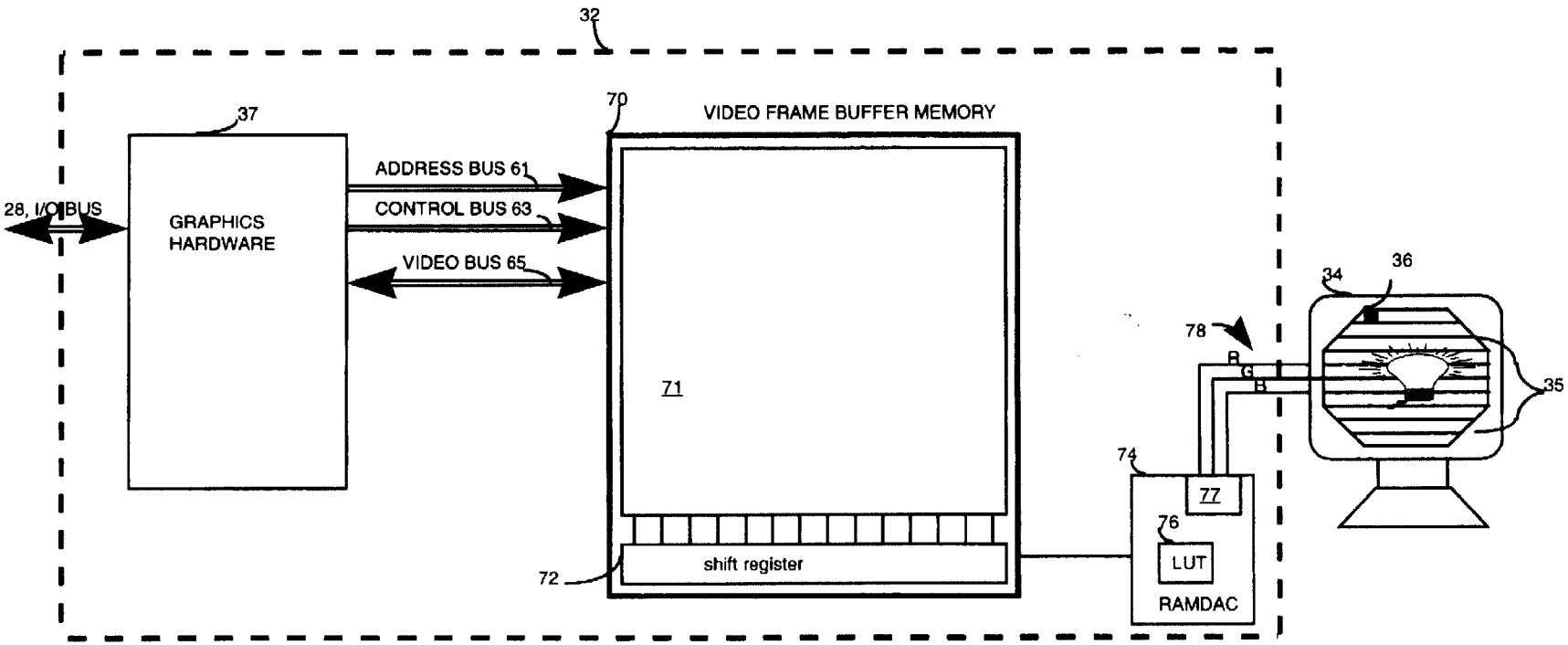
FIG. 3 is a block diagram of a video subsystem for use with the computer system of FIG. 2.

Referring now to FIG. 3, the graphics controller 32 of FIG. 2 is shown to include graphics hardware 37 and video frame buffer memory 70. The graphics hardware is coupled to the video frame buffer memory 70 by an address bus 61, a control bus 63 and a bidirectional video data bus 65. Data may either be written to the video frame buffer or read from the video frame buffer. Write data is forwarded from the I/O bus 28, through the graphics hardware 37 onto the video bus 65. Read data is forwarded from video frame buffer memory 70 onto video bus 65, through graphics hardware 37 onto the I/O bus 28.

In the present invention, video memory is apportioned into four discrete slices, each of which provide 16 bits of data to the video bus 65, which is therefore 64 bits wide. Because the internal data paths of the graphics controller are 64 bits wide, the data path can provide data for either two 32 bit pixels, four pixels using only 16 bits, or eight pixels using only 8 bits.

Video frame buffer memory comprises a plurality of video ram devices which include dynamic ram memory 71 coupled to a shift register 72. It should be noted that ordinary RAM may also be used to provide identical results. The video frame buffer memory stores picture element data, known as pixel data, which defines the color and/or intensity of a picture element which is to be displayed on the CRT. Each pixel is a binary field allocated either 32 bits, 16 bits or 8 bits. Data from the video memory 70 is periodically transferred to video shift register 72, and serially shifted out to a digital to analog converter (RAMDAC™) 74. The pixel data provided to the RAMDAC™ 74 is used to access a color Look Up Table (LUT) 76 which provides output data to digital-to-analog converters 77. The form of output data is dependent upon the mode in which the RAMDAC™ is operating. The digital to analog converters send three analog signals, R, G, and B on lines 78 to the CRT.

Graphics performance is typically measured by the amount of time that is required to update the image that is displayed on the CRT. Accordingly, the true measure of graphics performance lies in how quickly data in the video frame buffer memory 70 is updated. Because the video frame buffer is updated using data on the video bus, it is critical that the bus be maximally utilized. For example, if only 50% of the video bus is utilized in a given application, twice as many writes as necessary will be required to update the video frame buffer memory, thus reducing the performance of the graphics system.

The present invention maximizes the utilization of the video bus by providing a video system configured for optimum performance. There are three aspects to the above configuration which result in the performance gain of the graphics system. The first aspect lies in allocating appropriate pixels to slices of memory such that corresponding bytes of vertically or horizontally neighboring 64 bit groups of bytes are allocated to different slices of memory. The second aspect lies in providing hardware that allows for the individual memory slices to be independently accessed, thus allowing each slice to access data from a different 64 bit word in video memory during one video access period. The controllers which independently access the memory slices are advantageously totally time independent, to allow the most flexibility in the starting and finishing of the access of the memory slice. The third aspect that results in the performance gain is the buffering of both the read and write requests to the video memory. Buffering requests allows reads and writes to neighboring locations to be merged to allow for the maximal bus utilization while reducing stalling of the graphics subsystem due to pending reads from video memory.

In one embodiment of the invention, the storage locations of bytes for each pixel in the scan line are rotated, and offset pixels may be added to a scan line. By adding offset pixels to the scan line, the storage locations of bytes in consecutive scan lines stored in memory are rotated such that any byte of a scan line pixel is stored in a different slice of video memory than the same byte of the corresponding pixel in the next successive scan line. This property holds true whether the pixel is 32 bits, 16 bits or 8 bits. In addition, by rotating the bytes of contiguous pixels, it is ensured that the locations of corresponding bytes of neighboring pixels in the same scan line are stored in different slices of video memory.

It should be noted that it is not necessary to always extend a scanline to achieve the proper scanline to scanline rotation. For example, in a system where the screen width comprises 1280 pixels, an extension of two, eight byte groups (128 bits) would provide an appropriate scan line to scan line rotation amount (2 bytes). Thus, in a system of 32 bit pixels, the scan line would be extended 4 pixels to provide a 1284 pixel scan line. If the screen width was originally 1282 pixels, the extension need be only one eight byte group, to again provide 1284 pixels. And if the screen width is originally 1284 pixels, no scan line extension need be made.

In the preferred embodiment, an appropriate number of pixels by which the scan line should be extended (E) is a function of the screen width in pixels (SW), the number of slices of video memory (SN) and the physical width of the video bus in pixels (VBW), and can be determined by the below Equation I:

Equation I:

$$E=(SN*VBW)-1-((SW+SN*VBW/2-1) \bmod (SN*VBW))$$

For example, in the implementation of FIG. 3, SN=4, VBW=2 and thus for a scan line of 1280 pixels:

$$E=(4*2)-1-((1280+4-1) \bmod (4*2))=4$$

And therefore four pixels would be added to the scan line to achieve the correct scan line to scan line relationship.

It should be noted that extending the scan line is simply one means of accomplishing a scan-line to scan-line rearrangement. The same effect could be achieved by rearranging data using the y coordinate to provide a vertical rotation of scan lines, or by other methods well known to those of ordinary skill in the art.

Figure 4:
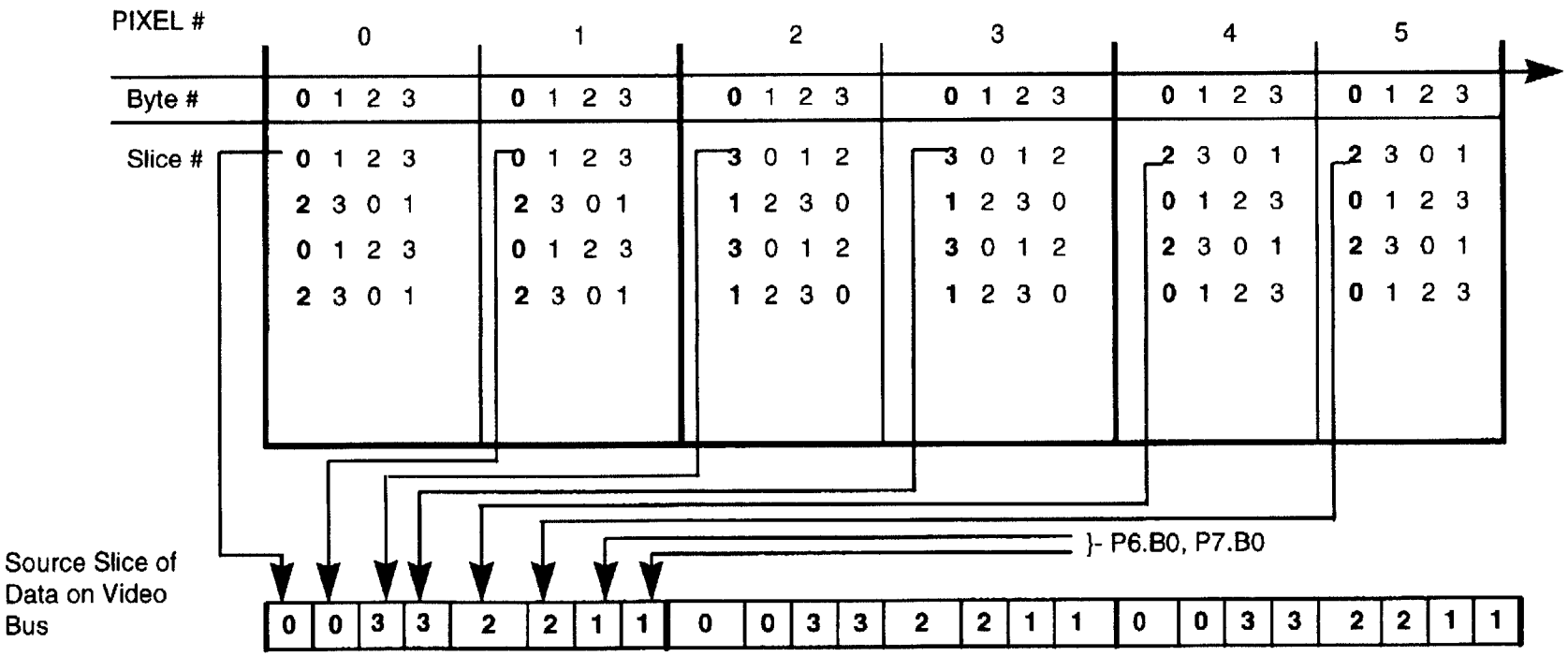
FIG. 4 illustrates an improved arrangement of 32 bit pixels stored in a 32 bit frame buffer, according to the aspects of the present invention, in the video memory of FIG. 3.

For example, referring now to FIG. 4, a video memory allocation has been provided where the pixel data rotates from 64-bit group to 64-bit group, to provide a memory layout where corresponding bytes of neighboring pixels are each stored in a different slice of the video memory. In a graphics system where the memory controllers operate independently, the performance of line drawing, stippling and DMA operations is increased with this arrangement because it allows for maximum utilization of the video bus 65.

Figure 1A:
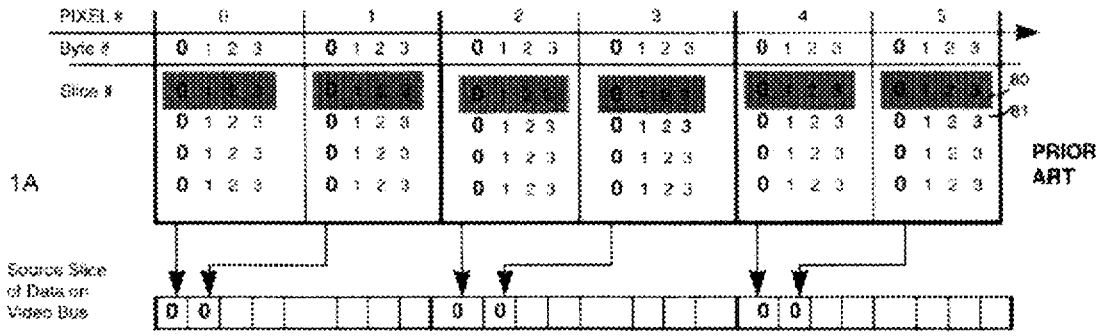
FIG. 1A is a block diagram illustrating a prior art layout of scan lines in a video memory.
Figure 1B:
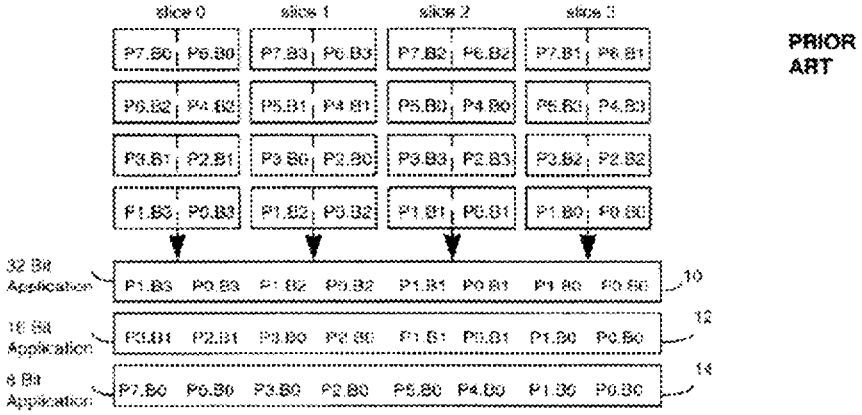
FIG. 1B is a block diagram illustrating a prior art method of handling bus underutilization for some partial pixel operations.

For example, referring again to our previously cited problems discussed with reference to FIGS. 1A and 1B, the allocation shown in FIG. 4 would provide improved performance for partial updates of contiguous pixels. As shown in FIG. 4, if only byte 0 of each pixel were updated, byte 0 of pixels 0 and 1 could be obtained from slice 0, byte 0 of pixels 2 and 3 could be obtained from slice 3, byte 0 of pixels 4 and 5 could be obtained from slice 2, and byte 0 of pixels 6 and 7 (not shown) would be obtained from slice 1.

As shown in FIG. 4, the present invention also improves the prior problems encountered in Z/Stencil buffer operations. Typically, each 32 bit Z/Stencil buffer pixel comprises two fields: an 8 bit stencil field, and a 24 bit Z value field. The majority of 3 dimensional operations only read and write the Z value field, and not the stencil field, so they operate on only three bytes of each 32 bit pixel.

Assuming that the stencil field is located in Byte 3 of the 32 bit pixel, during the first stencil operation, writes are generated to slices 0, 1 and 2. During the second stencil operation, writes are generated to slices 3, 0, 1, then to 2, 3, 0, then to 1, 2, 3. Accordingly, rather than performing 4 64-bit transactions where one slice is idle each cycle, each slice can be accessed during 3 memory transactions to write the required data.

Figure 5:
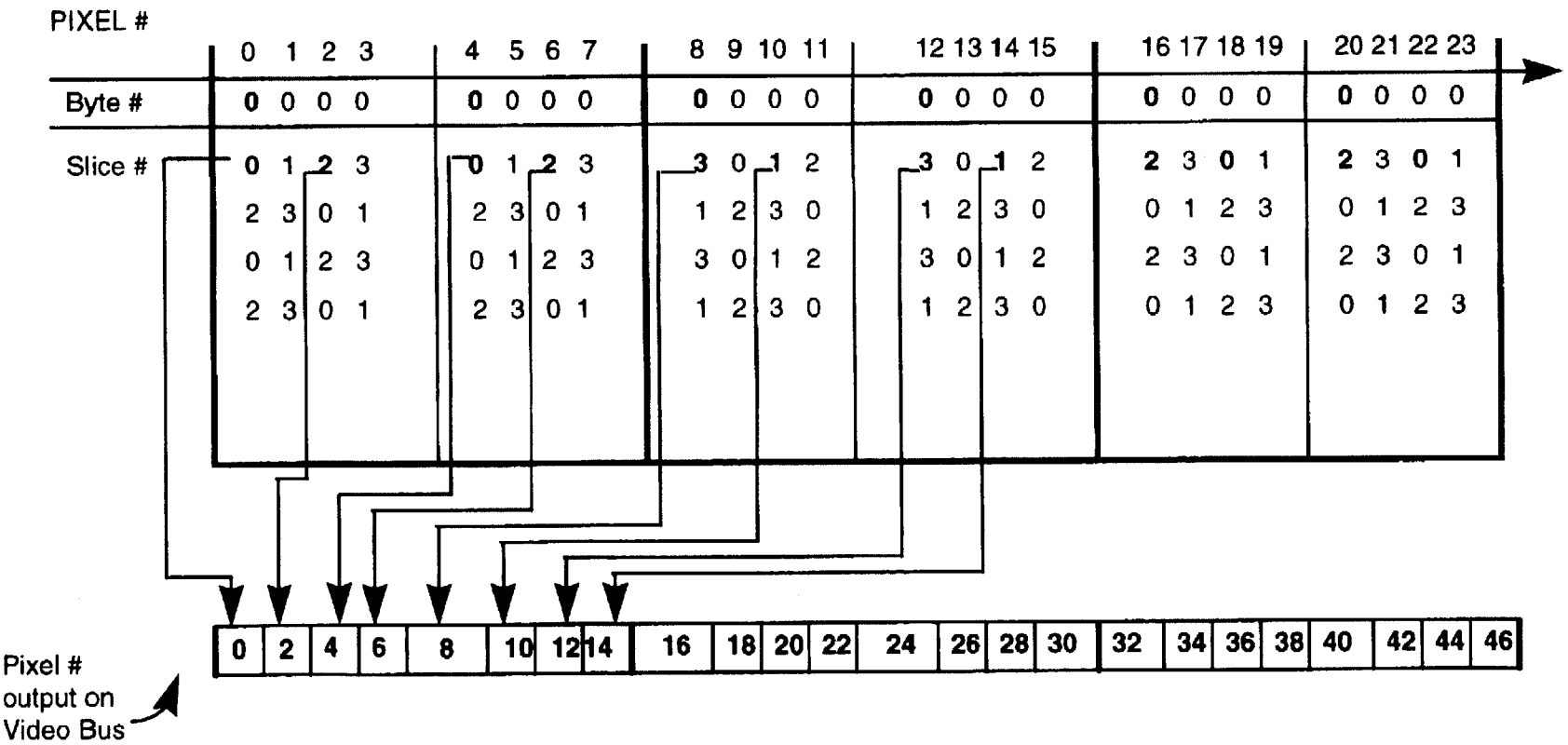
FIG. 5 illustrates an improved arrangement of 8 bit pixels stored in an 8 bit frame buffer, according to the aspects of the present invention, in the video memory of FIG. 3.

The present invention also improves stippling operations as follows. Referring now to FIG. 5, assuming an 8 bit pixel graphics application is executing in a graphics system where only 8 bits are physically allocated per pixel. The pixel number of each pixel is indicated, with one byte of data for each pixel (byte 0). To paint a stipple pattern of one pixel on/one pixel off across a scan line, one memory transaction would access slices 0 and 2 (to obtain pixels 0, 2, 4 and 6) while the next memory transaction would access slices 3 and 1 (to obtain pixels 8, 10, 12 and 14). As a result, the bus would be 100% utilized for this stipple operation, rather than only 50% utilized with the more typical pixel layout of the prior art. [It should be noted that the arrangement of pixels output on the bus is merely an exemplary illustration; in reality since slice 0 is storing pixels 0 and 4, those pixels may be output adjacent to each other on the bus, with bus receive logic having the capability of rearranging the pixels in the appropriate sequence].

Because the memory controllers operate totally independent of one another, all four slices can be accessed using different video memory addresses during one video reference operation, and consequently 64 bits of data may be provided to the video bus for this operation, providing full bus utilization.

Figure 6:
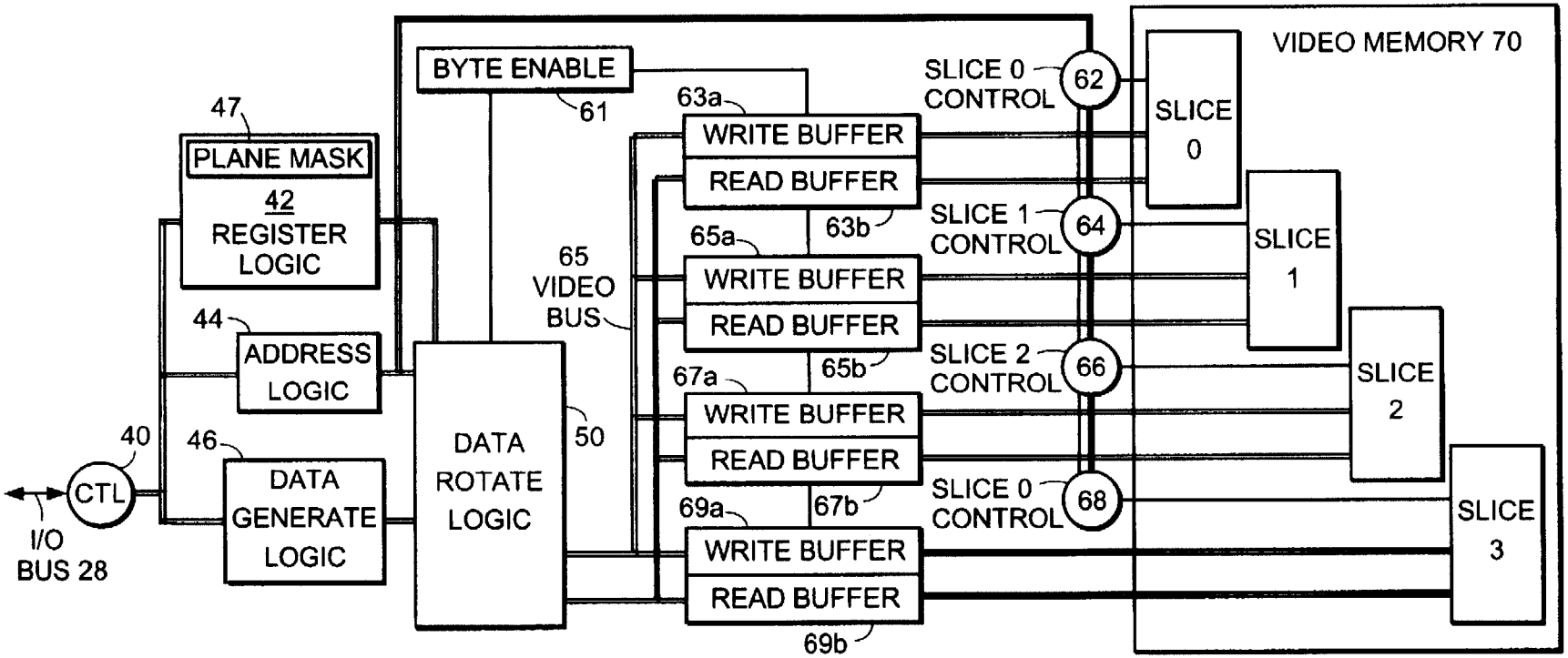
FIG. 6 is a block diagram illustrating graphics hardware which may be used to implement the present invention.

Referring now to FIG. 6, an example of graphics hardware 37 (FIG. 3) capable of operating in accordance with the three aspects of the invention cited above is shown. The graphics controller 32 of the present invention is shown to include control logic 40 for decoding the read, write, line, stippling and other commands received on I/O bus 28. The control logic 40, as well as address data from the I/O bus 28 is fed to an address generator 44. The address generator provides the appropriate addresses for operations in the video frame buffer 70. Also coupled to the I/O bus 28 is register logic 42.

Data generate logic 46 is also coupled to I/O bus 28. The data generate logic may be used to generate the appropriate data to be written to the video frame buffer from information provided on I/O bus 28. Data from the data generator is forwarded to data rotate logic 50.

The data rotate logic 50 operates to rotate the data stored in the video memory such that, during write operations corresponding bytes of neighboring pixels are stored in different slices of video memory 70. In addition, during read operations, the rotate logic rotates the data that was stored in the video memory 70 such that the data read from memory appears in the expected order on the I/O bus 28.

Most of the pixels that are forwarded from the data generate logic 46 are rotated by a given amount ranging from a value of 0 to (# slices of memory −1). It should be noted that the scan-line to scan-line rotation may be provided by adding offset pixels to the scan line using the method described above with reference to Equation I, or by other means known to those of skill in the art. The rotate logic acts to rotate the bytes within the pixels of the scan lines.

Basically, the amount by which each pixel is rotated in each successive 64 bit group should be to the granularity of the smallest sub-piece of a pixel that is commonly accessed (i.e. a byte). In the present embodiment, the rotation amount was selected to be one byte, which was the smallest portion of data that was commonly altered by the graphics controller.

In this embodiment of the invention, the data path is 64 bits wide. During operation, it may occur that only certain bytes of the data are to be read from or written to video memory 70. The address logic 44 forwards this byte select information to the data rotate logic. The byte select information by the data rotate logic 50 and is rotated on a bit-wise basis similarly with data from the data generate logic 46. The output is a byte enable 61, which is an N bit field (where N is the number of slices in video memory * the number of bytes stored in each slice) that dictates which bytes of which slices of the video memory 70 are to be updated by the given operation.

During read operations, data read from each slice of the video memory 70 is stored in an associated read buffer 63*b*–69*b*. The data stored in the read buffers 63*b*–69*b* is then rotated by the data rotate logic 50 and is either forwarded out over the I/O bus 28 to the CPU, or used by logic internal to the graphics controller.

The data that is read to or written from memory comprises 64 bits apportioned into four 16 bit slices. If the byte enable bits corresponding to one of the data slices are both 0, the associated data slice is dropped, and neither a read or a write will be performed for that data slice.

If either of the byte enable bits of a slice are non-zero, a write operation forwards the associated address and data to one of 4 dedicated write buffers (63*a*–69*a*). A read operation forwards the associated address to one of the 4 dedicated read buffers (63*b*–69*b*). In addition, each two bit portion of the byte enable field is forwarded along with the associated data and stored in the corresponding read or write buffer. Advantageously, the current address of the data stored in each buffer location is maintained, thus allowing for reads and writes to different bytes in the same slice to be merged where possible.

Each slice of video memory is independently addressed and controlled by a respective slice controller 62–68. The slice controllers 62–68 control the transfer of data between the respective write buffers 63*a*–69*a*, read buffers 63*b*–69*b*, video bus 65 and video memory 70.

By allowing each slice of video memory to be independently controlled, different scan lines can be accessed by different controllers in one operation. As a result, because each memory operation is not constrained to the same address for all slices, the video bus 65 may be fully utilized for video operations, and thus the overall performance of the graphics system is increased.

When data is read out of video memory 70, the restoration of data to the original byte sequence may be performed in a variety of ways. First, the rearrangement could be accomplished by directly wiring the output of the memory to feed the bytes to the RAMDAC in the correct order. Alternatively, a multiplexer could be provided in the path to handle the rearrangement, although this method is less desirable because of the added delay attributed to the mux. Also, many RAMDAC devices have a programmable input that allows for the bytes that are input to be rotated by a particular amount. This feature could also be used to restore the byte sequence.

Although a technique has been discussed that provides improved performance for accessing bytes of data from video memory, it should be appreciated that the inventive concept may be extended to providing improved performance for accessing any size subset of bits from memory. The minimum size of the subset of bits is dictated by the granularity of write control of the video memory. Therefore, if a system is able to read and write at a 4 bit granularity, one of skill in the art could easily modify the present invention to achieve maximum performance for the graphics system.

In addition, it should be noted that the described technique should not be limited to mere rotation of bytes within a pixel.

It is contemplated that other techniques, such as byte swapping, byte order inversion, and other techniques readily discernible by those of skill in the art would also be applicable for use in the present invention.

Accordingly, a system has been provided that increases the performance of certain graphics operations by rearranging the byte order of neighboring pixels. This rearrangement may be achieved by either rotating the bytes of successive pixels, or by rotating bytes and adding extra bytes to the end of a scan line to achieve the same result. However, this disclosure is not meant to be limited by these embodiments as it is readily understood that other means for achieving the same result may be developed by those of skill in the arts.

The present invention is further enhanced by the buffering of reads and writes to the separate slice of memory, each of which are independently controlled. Such an arrangement allows the full performance advantages to be realized via maximum utilization of the video bus. Of course, because any layout of pixels in memory can not be optimal for all operations, and the appropriate arrangement should be chosen by evaluating the tradeoffs for the particular mix of operations expected.

Having described a preferred embodiment of the invention, it will now become apparent to one of skill in the art that other embodiments incorporating its concepts may be used. It is felt, therefore, that this invention should not be limited to the disclosed embodiment, but rather should be limited only by the spirit and scope of the claims.

What we claim is:

1. A method for improving the performance of a graphics system, said graphics system including a memory for storing an image comprising a plurality of pixels, said pixels comprising a plurality of subsets of bits of data, said memory comprising a plurality of slices, said method comprising the steps of:

storing said pixels in said memory, where a first order of the subsets of successive pixels is rearranged such that corresponding subsets of vertically and horizontally neighboring pixels are stored in different, simultaneously accessible locations of said memory.

2. The method according to claim 1, wherein each of said slices of said memory are independently controlled.

3. The method according to claim 1, wherein said step of storing includes the step of:

generating, by said graphics systems said plurality of pixels;

rearranging said first order of said subsets of each of said plurality of pixels; and writing said rearranged subsets of pixels in said memory.

4. The method according to claim 1, further comprising the steps of:

reading said groups of subsets from said memory; and restoring said subsets of each of said pixels to said first order.

5. A method for storing pixel data in a video memory, said video memory apportioned into a plurality of slices, said pixel data comprising a plurality of subsets of data for display on a CRT comprising a plurality of scan lines, said method comprising the steps of:

receiving data from a CPU coupled to said video memory, and converting said received data into a plurality of pixels each comprising a plurality of subsets of data;

rearranging an order of each of said subsets of each of said pixels; and writing said pixels in said video memory, wherein the order of each of said subsets of pixels is rearranged such that corresponding subsets of vertically, horizontally, and diagonally neighboring pixels are stored in different, simultaneously accessible locations of said memory.

6. The method according to claim 5, wherein said pixels are rearranged by a determinable amount that is calculated responsive to a number of slices of said video memory.

7. The method according to claim 5, wherein rearranged subsets that require updating are temporarily stored in a buffer prior to said writing step.

8. The method according to claim 7, wherein each of said slices is allocated a respective buffer, and wherein each of said slices independently accesses data stored in its respective buffer for memory operations.

9. The method according to claim 5, further comprising the steps of:

reading, from said memory, said stored plurality of pixels;

storing said read plurality of pixels in a buffer; and restoring said subsets of each of said pixels to said order.

10. An apparatus comprising:

means, responsive to control information from a central processor unit, for generating pixels, each of said pixels comprising a plurality of subsets of bits;

a memory for storing said generate d pixels, said memory apportioned into a plurality of slices, said pixels stored such that corresponding subsets of vertically and horizontally neighboring pixels stored in different, simultaneously accessible locations of said memory.

11. The apparat us of claim 10, further comprising:

means for rearranging an original order of said subsets of data of each of said pixels responsive to the number of slices of said memory;

means for writing said subsets of data in said rearranged order to said memory.

12. The apparatus of claim 11, further comprising:

a buffer for storing said rearranged data prior to writing said rearranged data to said memory.

13. The apparatus of claim 10, further comprising:

means for reading said rearranged pixel data from said memory; and means for restoring said rearranged order of said subsets of data to said original order to provide said pixel data in a fixed byte order to said central processor unit.

14. The apparatus of claim 12, further comprising:

a buffer for storing data received from said memory during said read operation.

15. The apparatus of claim 10, further comprising:

a plurality of memory controllers, wherein there is one of said plurality of memory controllers for each one of said slices of said video memory, and wherein each of said memory controllers may independently address and control the associated slice of video memory;

a plurality of write buffers, corresponding to said plurality of memory controllers, each for storing a different portion of said subsets of data; and means for selectively enabling each of said memory controllers to control the writing of said associated portion of said data stored in said write buffer to said corresponding slice of video memory.

16. The apparatus of claim 15, further comprising:

a plurality of read buffers, corresponding to said plurality of memory controllers, each one of said read buffers for storing pixel information from said memory slice corresponding to said associated memory controller; and means for rearranging data received from said read buffers to provide pixel data in a fixed byte order to said central processing unit.

17. The apparatus of claim 10, wherein each pixel comprises four, eight bit subsets of data.

18. The apparatus of claim 10, wherein each pixel comprises two eight bit subsets of data.

19. The apparatus of claim 10, wherein said means for rearranging further comprises means for swapping the order of said subsets of data of said pixel.

20. The apparatus of claim 10, wherein said means for rearranging further comprises means for rotating the order of said subsets of data of said pixel.

* * * * *